US005509836A

United States Patent [19]

Ogasawara et al.

[11] Patent Number: 5,509,836

[45] Date of Patent: Apr. 23, 1996

[54] OUTBOARD MOTOR

[75] Inventors: Takio Ogasawara; Manabu Yamamoto, both of Hamamatsu, Japan

[73] Assignee: Sanshin Kogyo Kabushiki Kaisha, Hamamatsu, Japan

[21] Appl. No.: 399,207

[22] Filed: Mar. 6, 1995

[30] Foreign Application Priority Data

Mar. 7, 1994 [JP] Japan ..... 6-059830

[51] Int. Cl.[6] ..... B63H 21/24

[52] U.S. Cl. ..... 440/76; 440/900

[58] Field of Search ..... 440/53, 76–78, 440/900, 113; 123/195 P; 294/137

[56] References Cited

U.S. PATENT DOCUMENTS 1,854,196 4/1932 Irgens ..... 123/195 D 2,549,481 4/1951 Kiekhaefer ..... 440/53

2,676,559 4/1954 Davies ..... 440/77

*Primary Examiner*—Edwin L. Swinehart

*Attorney, Agent, or Firm*—Knobbe, Martens, Olson & Bear

[57] ABSTRACT

Two embodiments of carrying handles that can be permanently connected to an outboard motor for carrying the outboard motor when not in use. In each embodiment the carrying handle is connected so that it extends in a generally vertical direction in normal condition of the outboard motor and which can be grasped by a user for carrying of the outboard motor at the user's side, with the user's wrist in a normal condition. The carrying handle is associated with a latching bracket that latches the lower end of the handle to the clamping bracket for the carrying operation.

10 Claims, 5 Drawing Sheets

OUTBOARD MOTOR

BACKGROUND OF THE INVENTION

This invention relates to an outboard motor and more particularly to an improved carrying handle for an outboard motor.

With outboard motors, particularly those of small displacement, it is common for the outboard motor to be detached from a watercraft and carried by the user. In order to facilitate this carrying of the outboard motor, an accessory handle is frequently provided on the outboard motor and which defines a hand-grip portion that facilitates the operator's holding and carrying the outboard motor. These carrying handles are normally attached to the clamping bracket of the outboard motor so that the handle portion extends transversely to the outboard motor in a direction that extends generally parallel to the tilt pivot pin that connects the clamping bracket to the swivel bracket for the tilt and trim movement of the outboard motor. Although these carrying handles are advantageous, the prior art type of constructions have several disadvantages.

The first of these is that since the carrying handle gripping portion extends transversely to the outboard motor and parallel to the tilt axis, the operator must turn his wrist from a normal position which the hand occupies when the arm is disposed at the side of the body through 90 degrees. This is necessary so that the drive shaft housing and lower unit will extend along the side of the user when the outboard motor is being carried. This requires the carrier to place his wrist in an unnatural position, and this gives rise to strain on the user.

In addition, since the carrying handle is normally fixed relative to the clamping bracket, it is in a position where it can interfere with the tilt-up operation of the outboard motor when attached to the transom of the watercraft. Therefore, the operator must ensure that the carrying handle is swung out of the way during its use on the watercraft.

It is, therefore, a principal object of this invention to provide an improved and simplified carrying handle arrangement for an outboard motor.

It is another object of this invention to provide a carrying handle for an outboard motor wherein the carrying position is such that the operator need not turn his wrist from the normal walking position during the carrying of the outboard motor.

It is a further object of this invention to provide an improved carrying handle for an outboard motor that is mounted and constructed in such a way as to not interfere with the normal usage of the outboard motor when attached to a transom of an associated watercraft.

It is a further object of this invention to provide an improved and compact carrying handle assembly for an outboard motor that can become a permanent fixture of the outboard motor and yet can be operated so as to either function as a carrying handle or be neatly concealed when the outboard motor is attached to a watercraft.

SUMMARY OF THE INVENTION

This invention is adapted to be embodied in a carrying handle arrangement for an outboard motor having a power head consisting of a powering internal combustion engine and a drive shaft housing and lower unit that depends from the power head. The drive shaft housing and lower unit includes a propulsion device that is driven by the engine and which is utilized for propelling an associated watercraft when the outboard motor is attached to the watercraft. A carrying handle is provided that has a gripping portion which is disposed forwardly of the center of gravity of the outboard motor and which extends in a generally vertical direction so that the outboard motor can be carried at the side of an operator with the operator's wrist in a normal position during walking and carrying.

DETAILED DESCRIPTION OF THE PREFERRED EMBODIMENTS OF THE INVENTION

Figure 1:
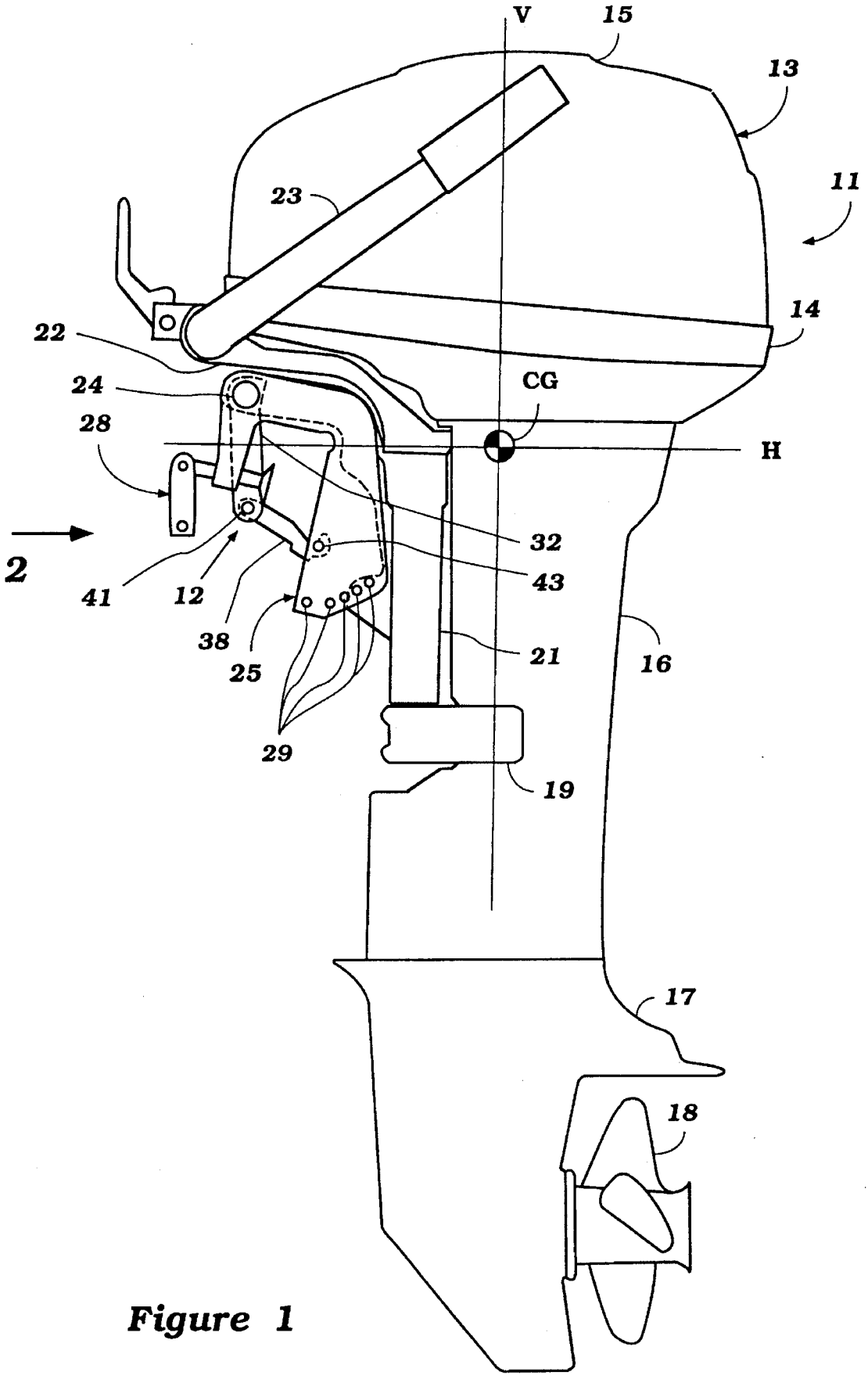
FIG. 1 is a side elevational view of an outboard motor constructed in accordance with an embodiment of the invention and showing the carrying handle in its carrying position.

Referring first to the embodiment of FIGS. 1–5 and initially primarily to FIG. 1, an outboard motor constructed in accordance with this embodiment is identified generally by the reference numeral 11. The outboard motor 11, as will be described, is generally conventional in its construction, and the following description of the conventional components is intended only to permit those skilled in the art to understand the environment in which the invention is utilized. The invention is comprised of a carrying handle, indicated generally by the reference numeral 12 and which is constructed and arranged as will be described in more detail by reference to the remaining figures of this embodiment.

The outboard motor 11 is comprised of a power head, indicated generally by the reference numeral 13, which is comprised of an internal combustion engine, which does not appear in the drawings, and which is encircled by a protective cowling that is comprised of a lower tray member 14 and a main cowling piece 15 that is detachably connected to the tray member 14 in any well-known manner.

As is typical with outboard motor practice, the engine of the power head 13 is supported so that its output shaft rotates about a vertically extending axis. This output shaft is connected to a drive shaft, which is also not shown in the drawings, which depends into and is journaled in a conventional manner within a drive shaft housing 16. This drive shaft depends through the lower end of the drive shaft housing 16 into a lower unit 17. At this lower end and within the lower unit 17 there is provided a conventional transmission, which may include a forward/neutral/reverse mechanism for driving a propeller 18 in selected forward or reverse direction.

A steering shaft (not shown is FIG. 1) is connected to the drive shaft housing 16 by means of a lower bracket 19 and an upper bracket which does not appear in FIG. 1. This steering shaft is journaled for steering movement within a swivel bracket assembly 21. A tiller 22 is affixed to the upper end of the steering shaft and carries a pivotally supported control handle 23, which is shown in the storage position in FIG. 1. The control handle 23 is pivotal to the tiller 22 to assume a horizontally disposed position wherein the outboard motor 11 may be steered about the steering axis defined by the steering shaft and the swivel bracket 21.

Figure 2:
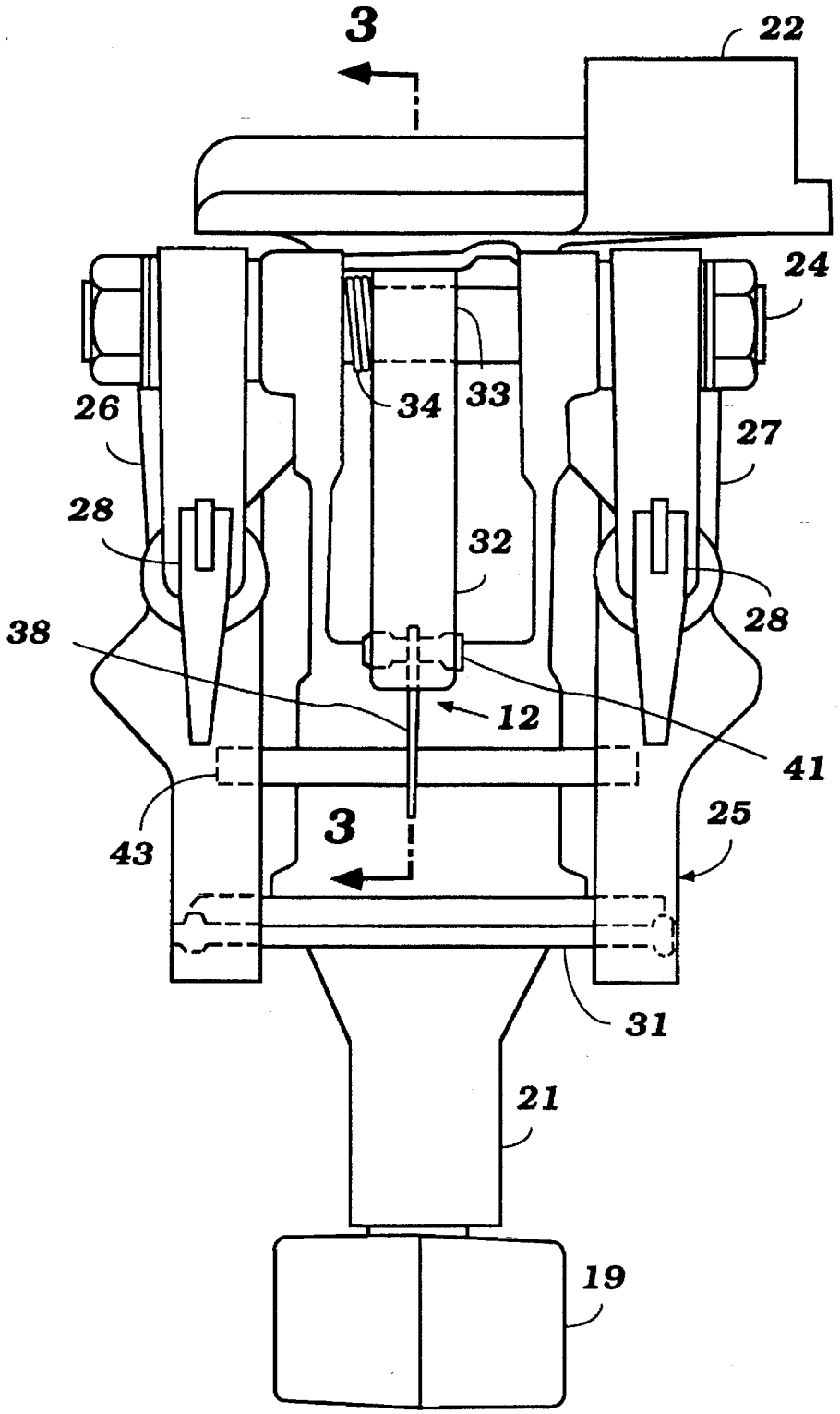
FIG. 2 is an enlarged view taken in the direction of the arrow 2 in FIG. 2 and still showing the carrying handle in its carrying position.
Figure 3:
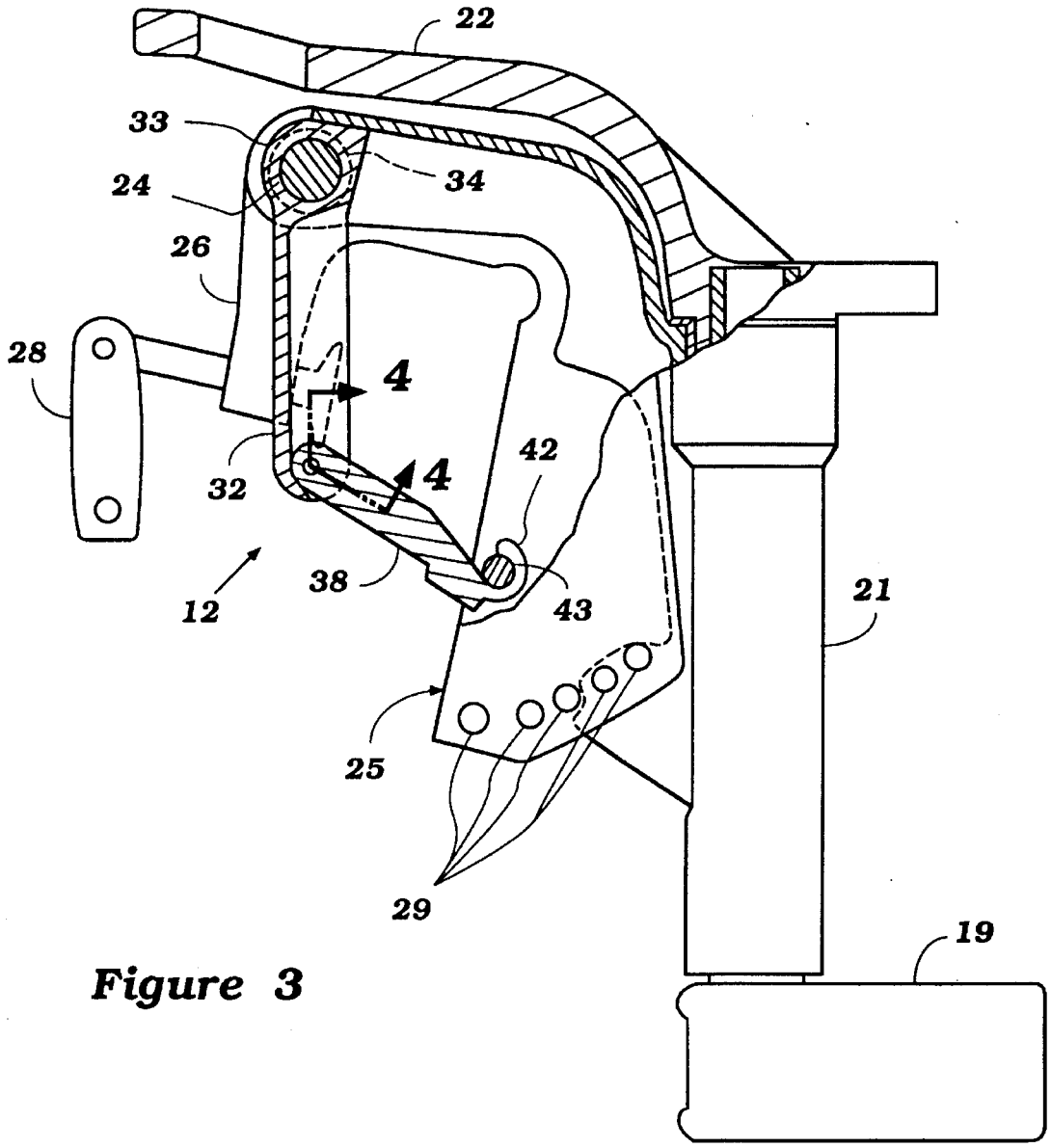
FIG. 3 is a cross-sectional view taken along the line 3—3 of FIG. 2.
Figure 4:
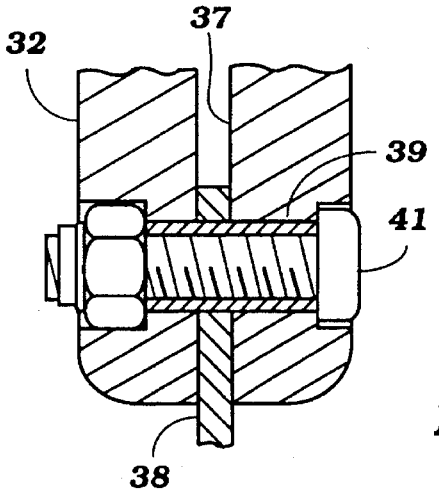
FIG. 4 is an enlarged cross-sectional view taken along the line 4—4 of FIG. 3.

The swivel bracket 21 is, in turn, pivotally connected by means of a pivot pin 24 to a clamping bracket assembly, indicated generally by the reference numeral 25. The clamping bracket assembly 25, as may be best seen in FIG. 2, is comprised of a pair of side portions 26 and 27, each of which has a generally inverted U-shape. The portions 26 and 27 carry screw-type clamps 28 that permit a detachable connection to the transom of an associated watercraft, as may be best seen in FIG. 5.

The pivot pin 24 permits tilt and trim adjustment of the outboard motor 11 relative to the clamping bracket 25. The trim-adjusted positions are set by means of a plurality of trim pin receiving apertures 29 formed in the clamping bracket side portions 26 and 27 and which are adapted to receive a trim pin 31 which is contacted by the swivel bracket 21 so as to control the trim-adjusted position of the outboard motor 11, as is well known in this art.

The construction as thus far described may be considered to be conventional and, for that reason, components of the assembly that are conventional will not be described again. Reference may be had to any known prior art type of construction for the details of the conventional components with which the invention may be utilized.

Figure 5:
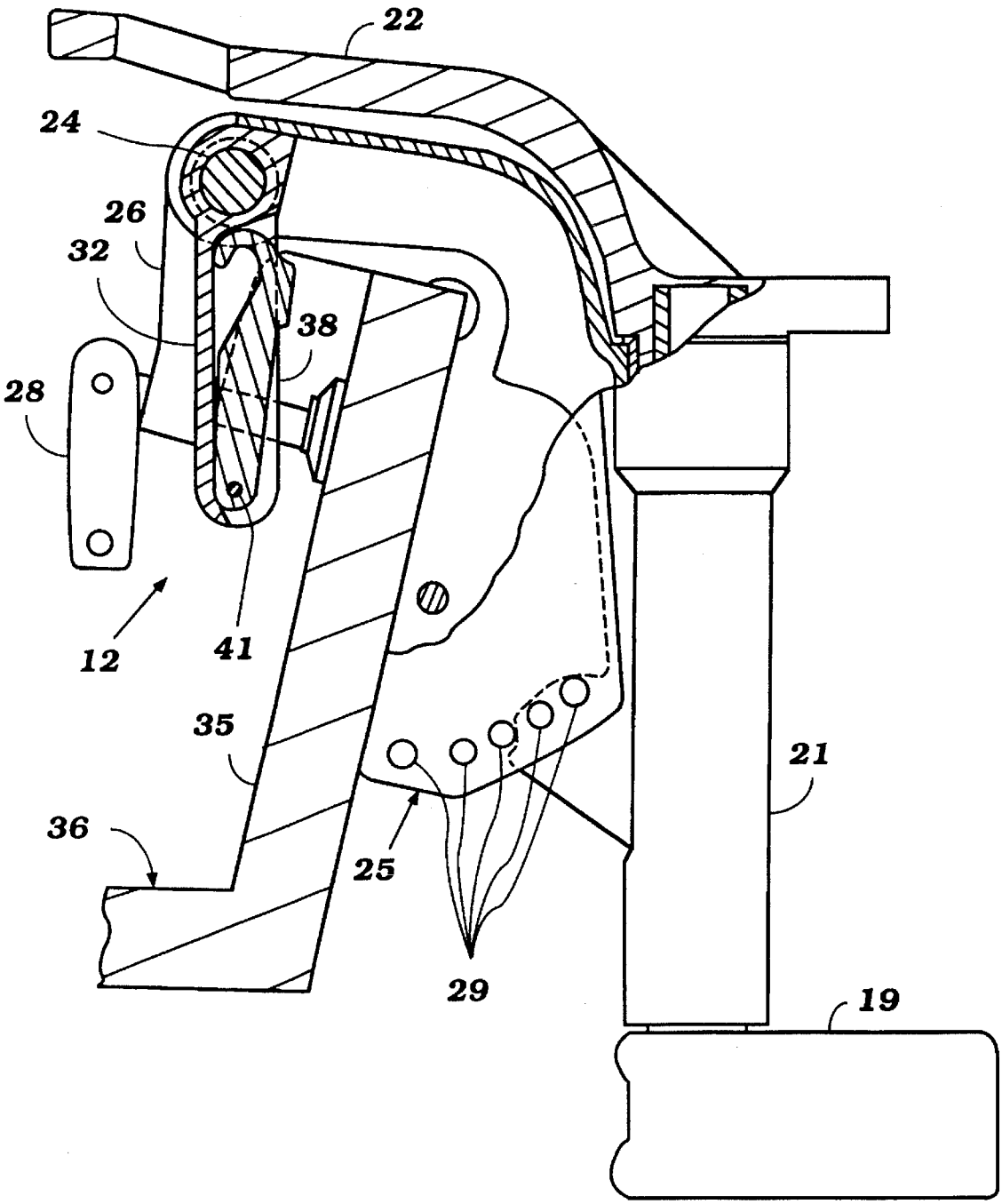
FIG. 5 is a view, in part similar to FIG. 3, but shows the carrying handle in its storage position and the outboard motor attached to the transom of an associated watercraft, which is shown partially and in cross section.

The carrying handle assembly 12 will now be described by primary reference to all figures of this embodiment (FIGS. 1–5) and includes a carrying handle portion 32 that has a trunnion part 33 that is rotatably journaled on the trim shaft 24. A torsional spring 34 encircles the trim shaft 24 and urges the carrying handle portion 32 in a clockwise direction. It should be noted that the portion 32 is disposed forwardly of the gap between the U-shaped legs of the clamping bracket side portions 26 and 27 so that it will be disposed forwardly of a transom 35 of an associated watercraft shown partially and in cross section in FIG. 5 when the outboard motor 11 is detachably connected to the watercraft 36. FIG. 5 shows how the clamping mechanisms 28 cooperate with the transom 35 so as to detachably connect the outboard motor 11 to the watercraft 36 in this condition.

The lower end of the carrying handle portion 32 is provided with a slotted opening 37 in which a latch 38 is pivotally supported on a pivot bushing 39 and clamping bolt and nut assembly 41. The latch 38 is provided with a hook-like end 42 spaced from its pivotal connection and which is adapted to be engaged with a pin 41 that is fixed to the sides 26 and 27 of the clamping bracket 25. When so latched, an operator can grasp the operating handle 32 and carry the outboard motor 11 at his side. Since the handle 32 extends in a generally vertical direction and is disposed forwardly of the center of gravity CG (FIG. 1) of the outboard motor, the outboard motor can be carried at the user's side, with his wrist in the normal position.

It should be noted that the center of gravity CG is disposed on a horizontal plane H that passes generally through the center of the carrying handle portion 32 and that this carrying handle portion 32 is disposed well forwardly of a vertical plane V that also passes through the center of gravity CG, as also shown in FIG. 1. Hence, there is a good balance that facilitates the carrying of the outboard motor and ensures that it will not tend to pivot or swing when being carried.

When the outboard motor 11 is attached to the transom of the watercraft (FIG. 5), the latch 38 may be pivoted upwardly to a nested position within the carrying handle portion 32 and locked there by tightening the clamping bolt 41. In this position the carrying handle assembly 12 is well clear of the outboard motor so that tilt and trim operation can be achieved without any interference from the carrying handle assembly 12.

Figure 6:
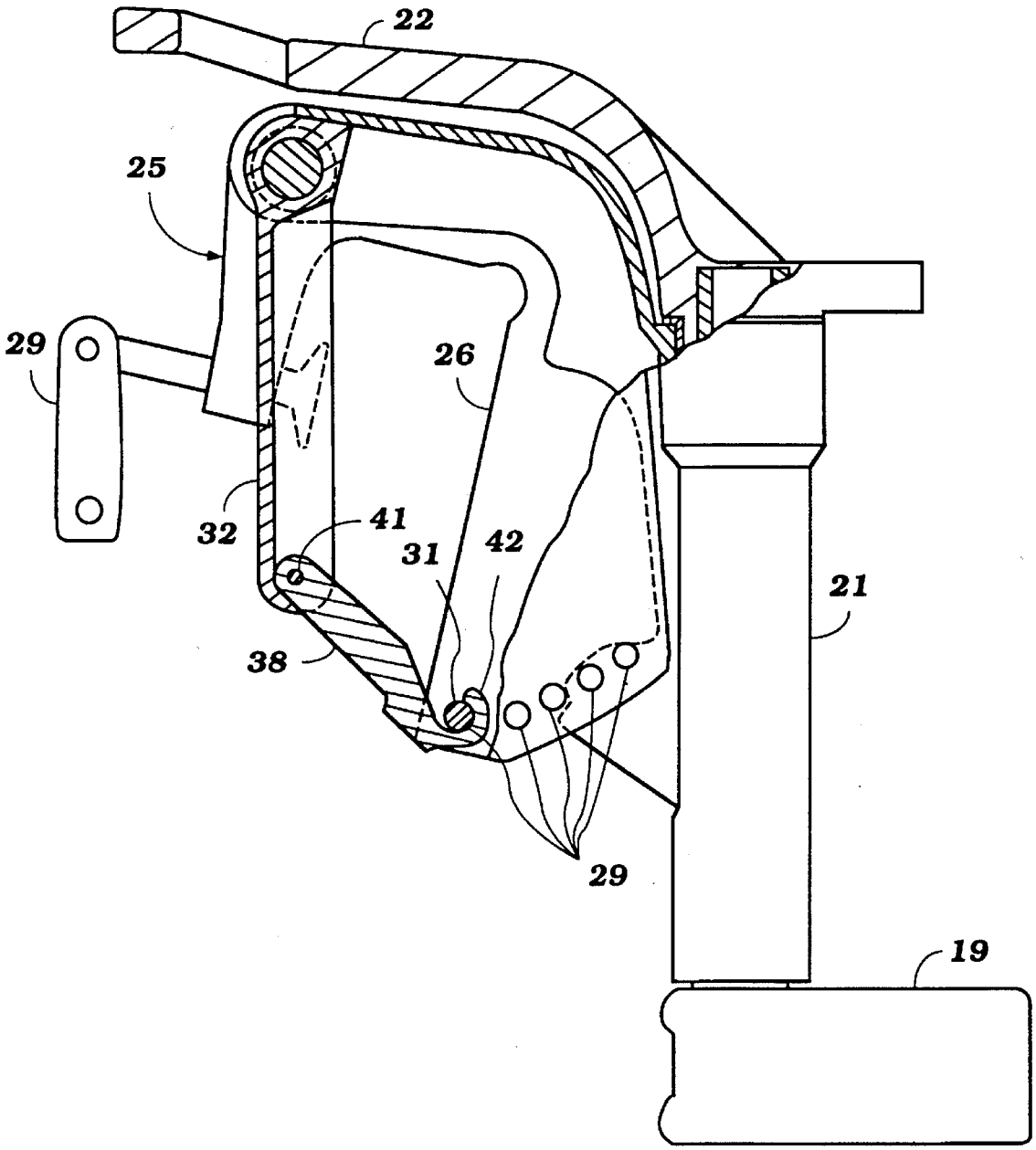
FIG. 6 is a cross-sectional view, in part similar to FIG. 3, and shows another embodiment of the invention.

In the embodiment of the invention as thus far described, the latch 38 of the carrying handle assembly 12 has cooperated with a separate latching pin 43 carried by the clamping bracket 25. FIG. 6 shows another embodiment of the invention which differs from that previously described only in the elimination of this separate latching pin 43. In this embodiment the carrying handle 32 is elongated so that the latch 38 can have its latching portion 42 engage the trim pin 31 when the trim pin is positioned in the lowermost of the trim-adjusting apertures 29. Thus, the additional pin is eliminated with this arrangement. In all other regards, this embodiment is the same, and for that reason, further description of it is not believed to be necessary to permit those skilled in the art to practice the invention.

From the foregoing description it should be readily apparent that the carrying handle assemblies embodying the invention are extremely effective and quite simple. Of course, the foregoing description is that of preferred embodiments of the invention, and various changes and modifications may be made without departing from the spirit and scope of the invention as defined by the appended claims.

I claim:

1. An outboard motor having a power head containing a powering internal combustion engine, a drive shaft housing and lower unit depending from said power head and containing a propulsion device driven by said internal combustion engine for propelling an associated watercraft, a swivel bracket pivotally connected to said drive shaft housing by a steering shaft for steering movement about an axis defined by said steering shaft, a clamping bracket comprised of a pair of spaced apart members adapted to be fixed to a transom of an associated watercraft for mounting said outboard motor on the watercraft, a horizontally extending trim pin pivotally connecting said clamping bracket to said swivel bracket for tilt and trim movement of said outboard motor relative to the watercraft, a carrying handle disposed between said clamping bracket spaced apart members and depending from said tilt pin and having a gripping portion disposed forwardly of the center of gravity of said outboard motor and extending in a generally vertical direction for carrying of said outboard motor at the side of a user with his wrist in a normal position.

2. An outboard motor as set forth in claim 1, wherein the carrying handle is pivotal about the trim pin.

3. An outboard motor as set forth in claim 1, wherein the carrying handle is disposed forwardly a transom of a watercraft when the outboard motor is in its normal operative position on the watercraft.

4. An outboard motor as set forth in claim 2, wherein the carrying handle is pivotally connected to a latching member at a point spaced from its pivotal connection to the trim pin and which latching member is adapted to be latchingly engaged with the outboard motor for precluding pivotal movement of the carrying handle relative to the outboard motor when being carried.

5. An outboard motor as set forth in claim 4, wherein the carrying handle is disposed forwardly of a transom of a watercraft when the outboard motor is in its normal operative position on the watercraft.

6. An outboard motor as set forth in claim 5, wherein the latching member is adapted to be latchingly engaged with a latch on the outboard motor for precluding pivotal movement of the carrying handle relative to the outboard motor when being carried.

7. An outboard motor as set forth in claim 6, wherein the latch is detachably connected to the clamping bracket.

8. An outboard motor as set forth in claim 7, wherein the latch comprises a pin carried by the clamping bracket.

9. An outboard motor as set forth in claim 8, wherein the spaced apart members of the clamping bracket are provided with a plurality of trim pin apertures for receiving a trim pin for setting the trim condition of the outboard motor when attached to an associated watercraft.

10. An outboard motor as set forth in claim 9, wherein the latching bracket is detachably connected to the trim pin for its latching operation.

* * * * *